US010293242B2

(12) United States Patent
Zoor et al.

(10) Patent No.: US 10,293,242 B2
(45) Date of Patent: May 21, 2019

(54) STOP FOR SHOE BINDING DEVICE

(71) Applicant: SKIS ROSSIGNOL, Saint-Jean-de-Moirans (FR)

(72) Inventors: Reinhold Zoor, Eichenau (DE); Jérôme Gillin, Rives (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 0 days.

(21) Appl. No.: 15/801,986

(22) Filed: Nov. 2, 2017

(65) Prior Publication Data

US 2018/0185737 A1 Jul. 5, 2018

(30) Foreign Application Priority Data

Nov. 2, 2016 (DE) ..... 10 2016 013 104

(51) Int. Cl.

| | |
|---|---|
| ***A63C 9/00*** | (2012.01) |
| ***A63C 9/08*** | (2012.01) |
| ***A63C 9/22*** | (2012.01) |
| ***A63C 9/085*** | (2012.01) |
| ***A63C 9/086*** | (2012.01) |

(52) U.S. Cl.

CPC ..... *A63C 9/0805* (2013.01); *A63C 9/085* (2013.01); *A63C 9/086* (2013.01); *A63C 9/0807* (2013.01); *A63C 9/08521* (2013.01); *A63C 9/08564* (2013.01); *A63C 9/08571* (2013.01); *A63C 9/22* (2013.01)

(58) Field of Classification Search

CPC ..... A63C 9/0807; A63C 9/003; A63C 9/10; A63C 9/001; A63C 9/08571

See application file for complete search history.

(56) References Cited

U.S. PATENT DOCUMENTS 4,166,636 A * 9/1979 Svoboda ..... A63C 9/001 280/625
4,522,423 A * 6/1985 Haldemann ..... A63C 7/1013 280/624
4,735,434 A * 4/1988 Sedlmair ..... A63C 9/08571 280/625
4,979,762 A * 12/1990 Gallet ..... A63C 9/005 280/625
5,899,484 A * 5/1999 Paradis ..... A63C 9/001 280/625

(Continued)

FOREIGN PATENT DOCUMENTS

EP 2 353 673 A1 8/2011

*Primary Examiner* — Hau V Phan

(74) *Attorney, Agent, or Firm* — Westerman, Hattori, Daniels & Adrian, LLP

(57) ABSTRACT

A toe piece for a device for fastening a boot on a sliding board, having a base (130; 3) intended to be fixed to the sliding board, two lateral jaws (101; 8, 9), each mounted to be rotationally mobile on the base (130; 3) about a substantially vertical rotation axis (103; 10, 11), so as to occupy a closed position to hold a boot and a separated position to release or receive a boot, and a pusher (110; 35) having two lateral trig surfaces (114; 24, 25) each cooperating with a respective ramp (104; 22, 23) of each jaw (101; 8, 9), this pusher being linked to the base by a trig spring (112; 36), and two links (120; 28, 29) each linked to a jaw by a first lateral axis (123; 14, 15) and linked together by at least one central axis (125; 32).

20 Claims, 9 Drawing Sheets

(56) References Cited

U.S. PATENT DOCUMENTS

| | | | | |
|---|---|---|---|---|
| 6,889,996 | B2 * | 5/2005 | Chonier | A63C 9/001 280/625 |
| 8,746,729 | B2 * | 6/2014 | Convert | A63C 9/10 280/613 |
| 2013/0328289 | A1 * | 12/2013 | Vailli | A63C 9/003 280/625 |
| 2014/0239615 | A1 * | 8/2014 | Rullier | A63C 9/0807 280/616 |
| 2015/0290524 | A1 * | 10/2015 | Soldan | A63C 9/10 280/615 |

* cited by examiner

SECTION F-F

SECTION A-A

SECTION B-B

FIG.25
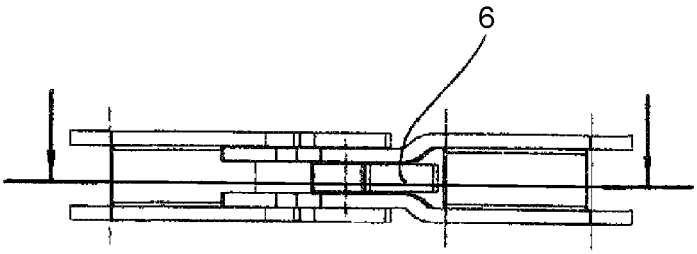
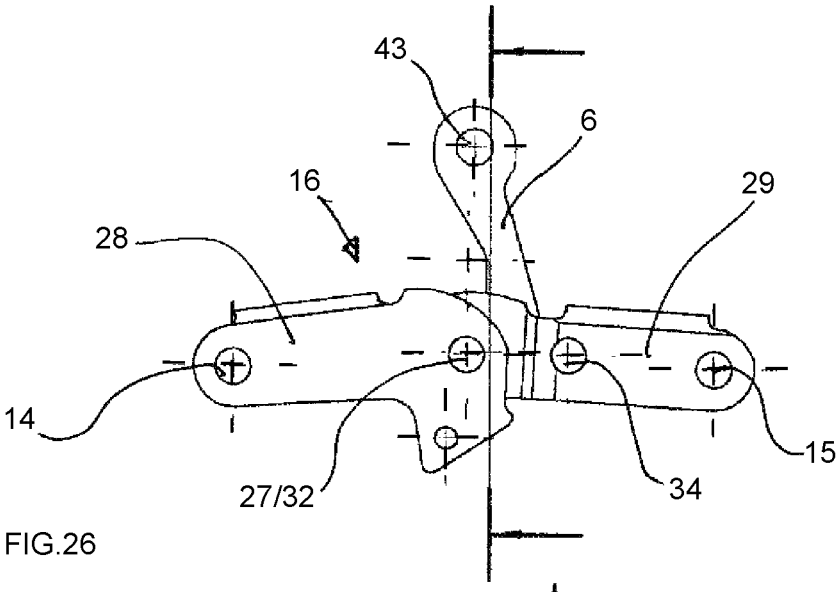
FIG.26
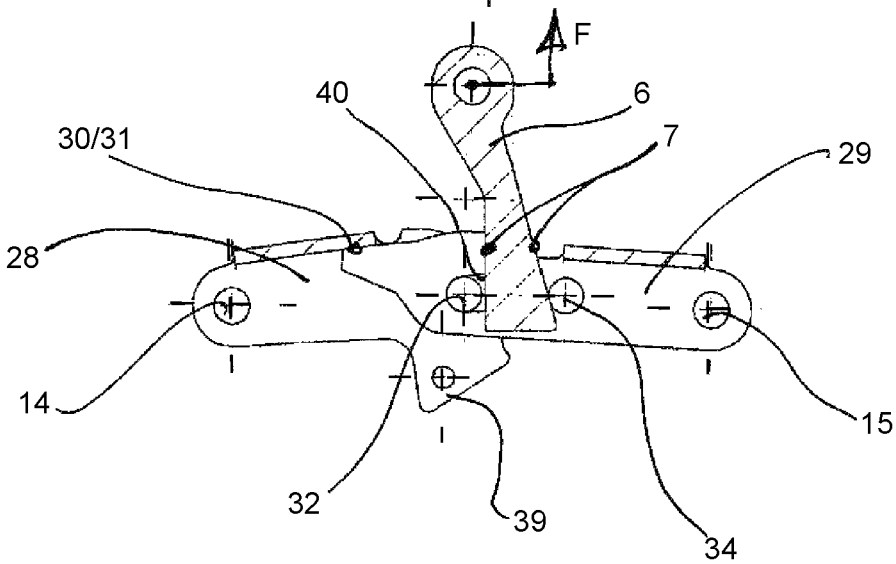
FIG.27

STOP FOR SHOE BINDING DEVICE

This application claims priority of the application in Germany number DE102016013104.7 filed on Nov. 2, 2016, which is hereby incorporated by reference in its entirety in this application.

BACKGROUND ART

The invention relates to a toe piece of a device for fastening a boot on a sliding board. This toe piece is particularly suited to ski touring. It relates also to a device for fastening a boot on a sliding board and a sliding board as such equipped with such a fastening device and/or such a toe piece.

The document EP-A1-2353673 describes a toe piece of a device for fastening a boot on a touring ski. The front fastening of the boot rests on two jaws of the toe piece articulated on longitudinal pivoting axes relative to a base of the toe piece intended to be fastened to the touring ski. Each jaw comprises retaining elements intended to cooperate with the touring ski boot. The two jaws are articulated by a spring system in order to occupy a so-called closed stable first position in which the retaining elements cooperate with corresponding hollow parts formed laterally in the anterior part of the touring ski boot, in order to fasten the boot by allowing only its rotational movement about an axis transverse to the ski, and a so-called open stable second position in which the jaws are separated such that the retaining elements release the boot which can be separated from the touring ski. The fastening of the front part of the boot on a touring ski equipped with such a toe piece is performed by positioning the boot while the two jaws occupy the open second position, then by pressing strongly with the sole of the boot on the spring-based system which makes it possible for the articulated jaws to switch to their closed first position in which they are close to the boot in order to position the retaining elements in complementary hollow parts of the boot.

SUMMARY OF THE INVENTION

One drawback with such existing toe pieces is their lack of safety should a skier fall, particularly in the case of a twisting fall of the skier in an alpine ski downhill situation, involving a twisting movement of the boot relative to the ski during which the boot remains captive in the toe piece, which risks causing injuries to the skier.

More generally, in addition to their lack of safety, the toe pieces of the prior art present many other drawbacks, including the fact that they are difficult to maneuver, and therefore not very user friendly, and are complex, bulky and/or heavy.

The aim of the present invention is to propose a solution for fastening a boot on a sliding board which remedies the drawbacks listed above.

A first object of the present invention is to provide a solution for fastening a boot on a sliding board, in particular on a touring ski, that guarantees optimal safety for the skier in the event of a fall.

A second object of the present invention is to provide a boot fastening solution that is simple, easy to maneuver, not bulky, economical and lightweight.

These aims can be achieved via a toe piece for a device for fastening a boot on a sliding board, comprising a base intended to be fixed to the sliding board, and characterized in that it comprises two lateral jaws, each mounted to be rotationally mobile on the base so as to be able to occupy a closed position in which they are able to hold a boot on a sliding board and a separated position in which they are able to receive a boot, a pusher comprising a trig surface cooperating with a ramp of each jaw, this pusher being linked to the base by a trig spring which makes it possible to control its displacement, and two links linked together and each linked to a jaw.

The invention is more specifically defined by the claims.

BRIEF DESCRIPTION OF THE DRAWINGS

Other advantages and features will emerge more clearly from the following description for particular embodiments of the invention given as nonlimiting examples and represented in the attached drawings, in which:

FIG. 25 illustrates a rear view of details of the links of the toe piece according to the second embodiment of the invention.

FIG. 26 illustrates a plan view of details of the links of the toe piece according to the second embodiment of the invention.

FIG. 27 illustrates a plan view in cross section of details of the links of the toe piece according to the second embodiment of the invention.

DETAILED DESCRIPTION OF PARTICULAR EMBODIMENTS

Figure 1:
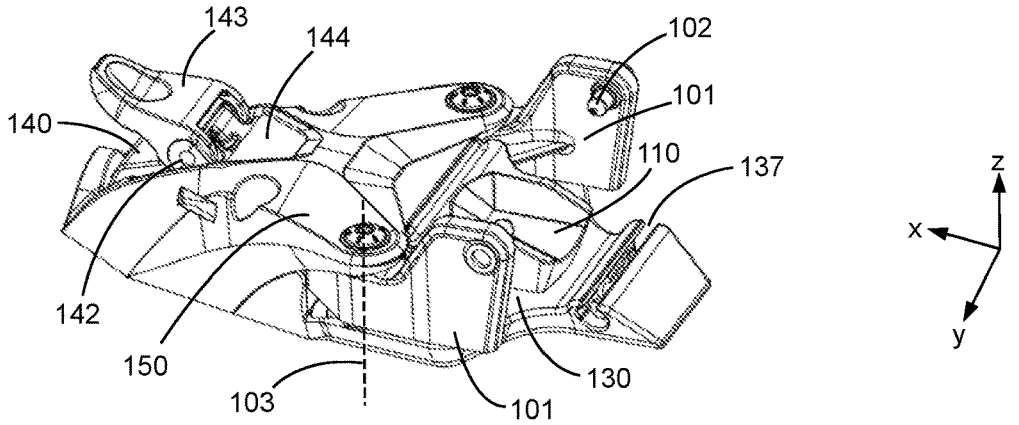
FIG. 1 represents a rear perspective view of a toe piece according to a first embodiment of the invention.
Figure 3:
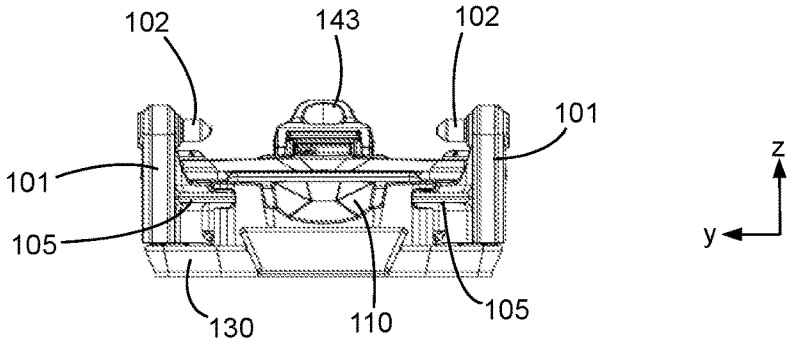
FIG. 3 represents a rear view of the toe piece according to the first embodiment of the invention.

The following description relates to a toe piece or front fastening element of a device for fastening a boot on a sliding board (not represented). This toe piece ensures the fastening of the front part of the boot and is particularly suited to the practice of ski touring, but does not exclude use in the context of alpine skiing and/or cross-country skiing. More generally, the toe piece forms part of the construction of the device for fastening the boot on the sliding board together with a rear heel piece (not represented) optionally ensuring the fastening of the rear part of the boot.

FIGS. 1 to 17 illustrate a first embodiment of such a toe piece. FIGS. 18 to 26 illustrate a second embodiment of such a toe piece.

To simplify the understanding of the description below, an orthonormal reference frame is associated with the toe piece, the longitudinal direction X of the toe piece being the horizontal direction, oriented from the rear to the front of the toe piece, this longitudinal direction also corresponding to the direction from the rear to the front of a ski on which the toe piece is intended to be arranged. The transverse direction Y corresponds to the horizontal direction at right angles to the direction X and oriented from right to left. The horizontal plane thus corresponds to a plane parallel to the surface of a ski on which the toe piece is intended to be arranged.

The vertical direction Z is at right angles to the horizontal plane defined by the directions X and Y and is oriented upward.

The toe piece according to the embodiments of the invention is substantially symmetrically arranged in relation to a vertical longitudinal median plane, and from time to time we will describe only one side of the toe piece in detail, the opposite second side being similar because it is symmetrical.

According to the first embodiment, the toe piece comprises a base 130 intended to be fixed to a sliding board, and mobile elements arranged on this base 130. It also comprises a top cap 150 positioned in front of the jaws and covering all or part of the mobile elements. It also comprises a substantially cylindrical recess 137 in the rear part, provided to receive a connection pin of a boot, not represented.

The toe piece first of all comprises two rigid jaws 101, arranged laterally and in the rear part of the toe piece. Each jaw 101 comprises a retaining element 102 intended to ensure the retention of the boot when the jaw is in a closed position, which will be detailed later. The retaining element 102 takes the form of a holding pin intended to engage in lateral openings formed in the front part of the boot. It is thus oriented toward the center of the toe piece, in a substantially transverse direction. Each jaw extends substantially longitudinally on each side of the toe piece, so as to be able to cooperate with the two lateral surfaces of a boot.

Each jaw 101 is mounted to pivot relative to the toe piece, more specifically relative to the base 130, about a substantially vertical rotation axis 103. The retaining element 102 is positioned in the rear and upper part of the jaw, in particular at the rear of the rotation axis 103 of the jaw. The result thereof is that each retaining element 102 can be separated outward by rotation of the jaw 101, thus allowing the fitting and the removal of a boot. Naturally, each jaw 101 can occupy a position of closure in which its retaining elements 102 are able to hold a ski boot. A return spring inserts a force on the jaw tending to hold it in its position of closure. According to this embodiment, this return spring is a trig spring 112 which will be described below. Furthermore, each jaw 101 comprises reinforcing fins 105, to allow them to undergo high stresses without risk. These fins extend in a substantially horizontal plane XY. They are wide enough and slide in lateral grooves of a pusher 110 which will be described below.

Each jaw 101 also comprises a particular part arranged around the rotation axis 103, oriented toward the interior of the toe piece, one end of which forms a substantially vertical rear surface forming a ramp 104 intended to cooperate with a trig surface 114 of a pusher 110, according to a mode of operation which will be detailed hereinbelow. This ramp 104 is arranged at the rear of the rotation axis 103 of the jaw 101.

This particular part arranged around the rotation axis 103 of each jaw 101 also comprises a front end, positioned in front of the rotation axis 103, supporting a link 120 by a lateral axis 123.

Thus, each jaw 101 supports a link 120 by a lateral axis 123. The toe piece therefore comprises two links 120. These two links 120 extend in a substantially transverse direction, variable angularly according to the configuration of the toe piece, and are articulated to one another by a central axis 125 arranged in the central part of the toe piece. Such a central axis 125 is free to move relative to the base 130 of the toe piece. This central axis 125 is secured to a pusher 110 and its displacement is guided by the pusher 110 in such a way that it is a longitudinally translational displacement.

Finally, as described previously, the toe piece comprises a pusher 110, translationally mobile longitudinally. To guide and make reliable this displacement of the pusher 110, the latter comprises a longitudinal central runner in which is positioned a block (or several blocks) 131 fastened onto the base 130 of the toe piece. The pusher is subjected to the force of a trig spring 112, extending longitudinally in a central part of the toe piece, and of which a rear end is fastened to a rear stop 132 of the base 130 and a front end is fastened onto the pusher 110. The latter also comprises two lateral trig surfaces 114, intended to cooperate with the ramps 104 of the jaws 101. These trig surfaces 114 are arranged in the front surface of lateral fingers of the pusher 110; these fingers extend transversely with an inclination towards the front. The force exerted by the trig spring 112 can be set by displacing the rear stop 132 via an adjustment screw 133, arranged in a front-end surface of the toe piece.

The operation of the toe piece will now be explained. It can occupy three main configurations, called fitting, climb and downhill or ski.

FIGS. 4 to 7 illustrate the toe piece in fitting configuration. In this position, the central axis 125 of the links 120 is positioned in a rear position, by an actuation device which will be detailed hereinbelow. In this position, the central axis 125 comes almost into transverse alignment with the two rotation axes 103 of the jaws 101. This retracted position of the links induces a traction toward the center on each lateral axis 123 of the links, which consequently exerts a rotational torque on the jaws 101, and drives the jaws 101 in rotation outward toward the outside of the toe piece. This makes it possible to free a central space between the two retaining elements 102 to allow for the positioning of a ski boot in a toe piece fitting operation, or the removal of a boot in a boot removal operation. In this operation, each of the jaws 101 is separated outward by an angle of between approximately 8 and 15 degrees inclusive.

It should be noted that, in this fitting configuration of the toe piece, the pusher 110 is similarly positioned in a retracted position, in which the trig spring 112 is slightly compressed.

Figure 9:
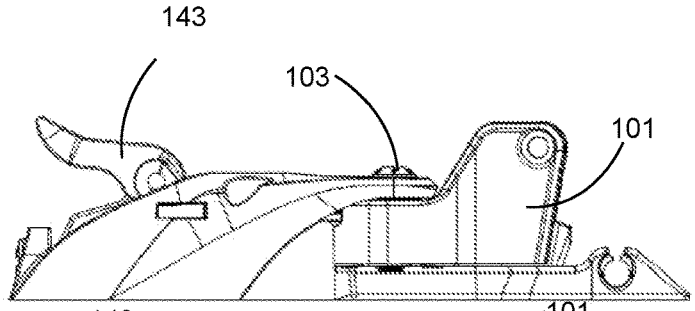
FIG. 9 represents a side view of the toe piece according to the first embodiment of the invention in the downhill configuration.
Figure 10:
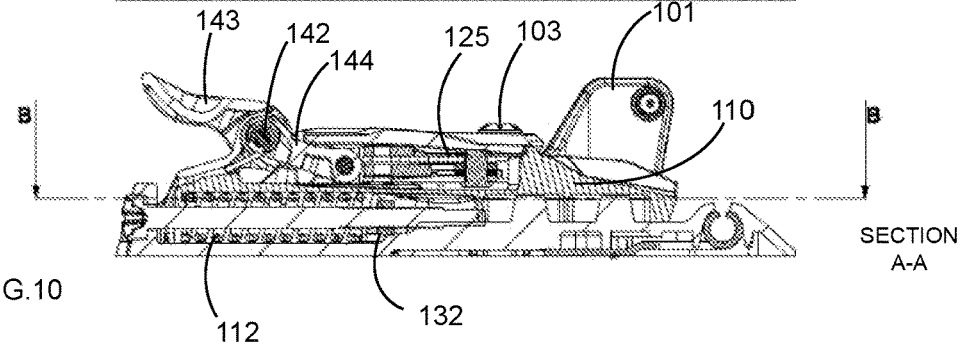
FIG. 10 represents a side view in cross section along a vertical longitudinal medium plane of the toe piece according to the first embodiment of the invention in the downhill configuration.
Figure 8:
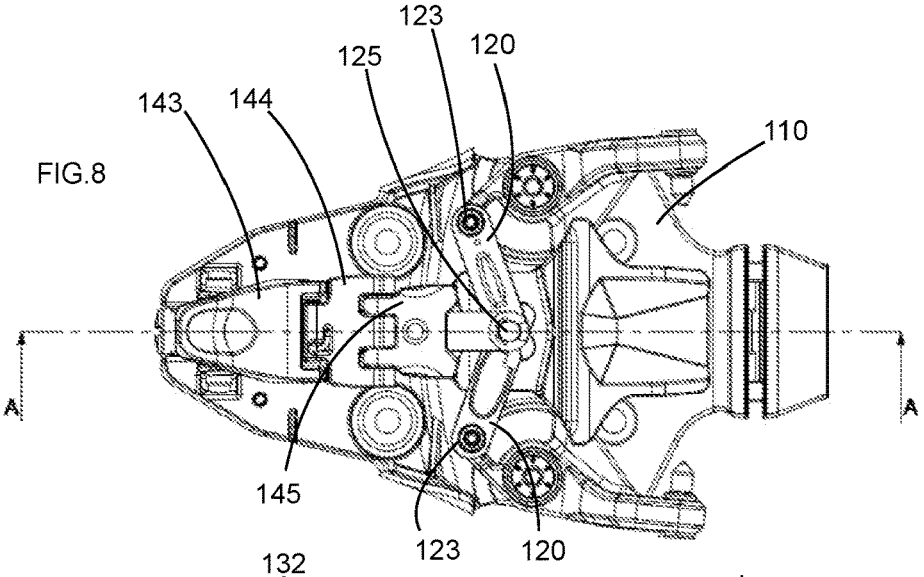
FIG. 8 represents a plan view without cap of the toe piece according to the first embodiment of the invention in a downhill configuration.
Figure 11:
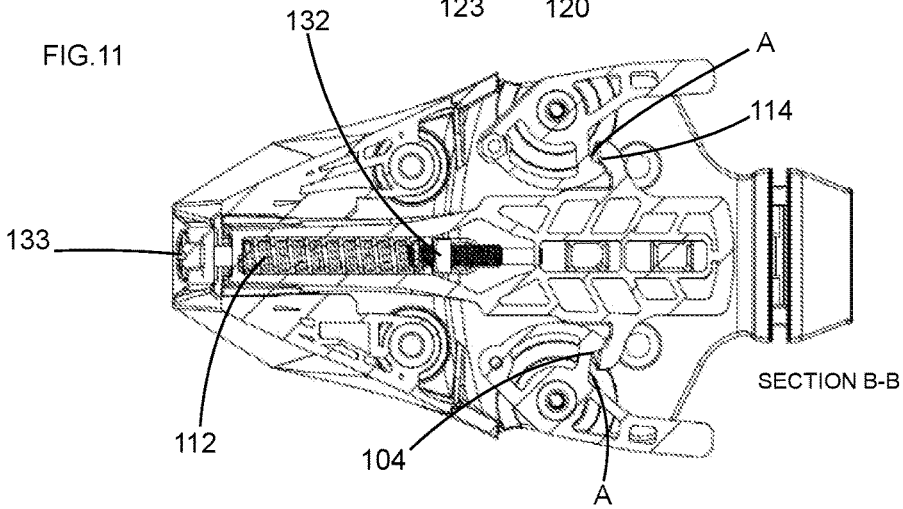
FIG. 11 represents a plan view in cross section along a horizontal plane of the toe piece according to the first embodiment of the invention in the downhill configuration.
Figure 13:
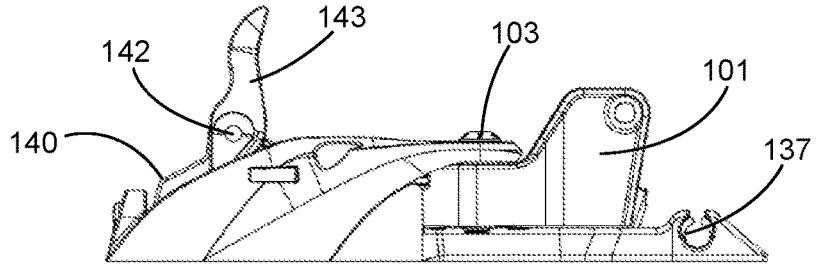
FIG. 13 represents a side view of the toe piece according to the first embodiment of the invention in the climb configuration.
Figure 15:
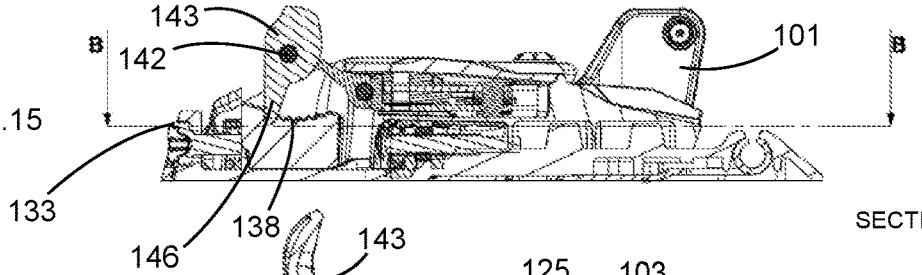
FIG. 15 represents a side view according to a second cross section of the toe piece according to the first embodiment of the invention in the climb configuration.
Figure 14:
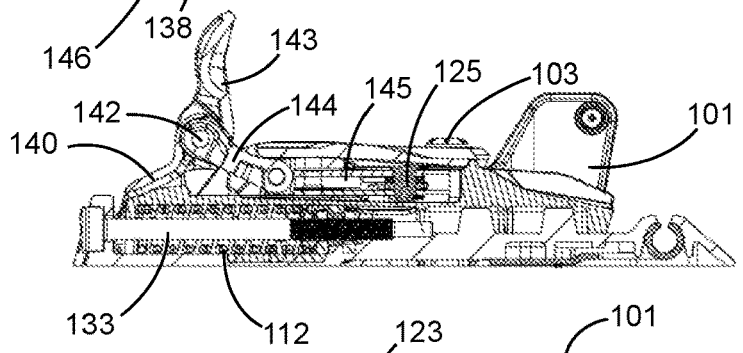
FIG. 14 represents a side view according to a first cross section of the toe piece according to the first embodiment of the invention in the climb configuration.

When the boot is positioned in the toe piece in fitting configuration, the actuation of the toe piece is released by the actuation device which will be described hereinbelow, such that the pusher 110 reverts to its more advanced rest position under the effect of the trig spring 112, returning the jaws 101 by rotation to their closed position and the central axis 125 of the links 120 in forward position, to obtain the downhill configuration, represented by FIGS. 9 to 11, in which the retaining elements 102 are fitted in voids of a boot, not represented, to hold it.

In this downhill configuration, the jaws 101 are held closed so as to guarantee the holding of a boot, not represented. However, if a lateral force is exerted by the boot on a jaw, in particular upon a twisting of the boot, the jaw has a degree of freedom in rotation about its rotation axis 103 and can slightly accompany the boot in an outward twisting movement. Such a movement of a jaw involves a similar simultaneous displacement of the second jaw 101 toward the inside via the links 120 which link the two jaws. By this link mechanism, the two jaws have a certain freedom of rotation which allows them to slightly follow the boot in its lateral pressures, to a maximum angle of approximately 20 degrees, in an elastic travel of the toe piece, with an elastic return toward the recentering of the jaws.

Such a toe piece also advantageously implements a trig function, which thus ensures an essential safety function. Indeed, when the boot exerts a twisting force on a jaw, the latter can turn about its rotation axis 103, as described above. Such a rotation causes a relative displacement of the ramp 104 of the jaw relatively to the trig surface 114 of the pusher 110. This cooperation of the two surfaces is such that the pusher is displaced toward the rear, against the trig spring 112. When the force exerted by a boot is significant, particularly in a fall, it is exceeds a threshold beyond which the ramp 104 of the jaw is displaced over the whole length of the trig surface 114, against the opposing force exerted by the trig spring 112, until it goes beyond a particular point A on the trig surface 114 and escapes from it, in which case the jaw 101 is then free to continue its rotational movement with little retention, allowing the boot to be released. The relative slip of the ramp 104 of the jaw relatively to the trig surface 114 of the pusher makes it possible to define an elastic travel to the point A. Beyond this point A, the jaw opens totally outward, to an angle greater than degrees, allowing the boot to escape.

In the implementation of this function, it therefore appears that the combination of the forms of the ramp and of the trig surface, in cooperation with the adjustable force exerted by the trig spring 102, makes it possible to define the optimal trig threshold to guarantee the safety of the skier. The two complementary surfaces, the ramp of the jaw and the trig surface of the pusher, which slide relative to one another, are therefore conformed to best fulfil the trig function.

Finally, the toe piece can be positioned in a third, so-called climb configuration, in which the boot is held by the jaws in a locked manner, that is to say in a way in which the trigging is not possible, is inactive. It is in fact important to prevent any trigging of the toe piece in a climb phase, to guarantee the safety of the skier when climbing, preventing in particular the loss of a ski. This climb configuration is represented by FIGS. 12 to 17.

According to the embodiment of the invention, the toe piece is also actuated by an advantageous actuation device which will now be described, and which is particularly visible in FIGS. 6, 10, 14 and 15.

Figure 2:
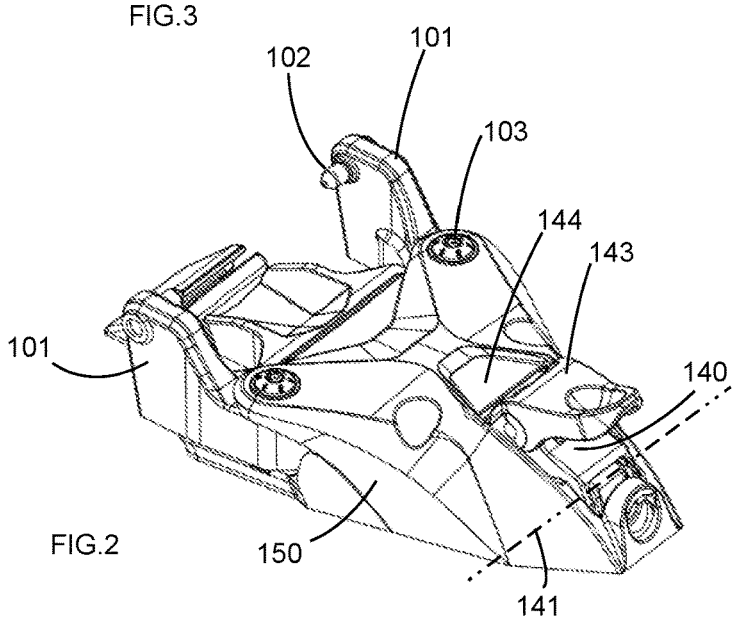
FIG. 2 represents a front perspective view of the toe piece according to the first embodiment of the invention.
Figure 5:
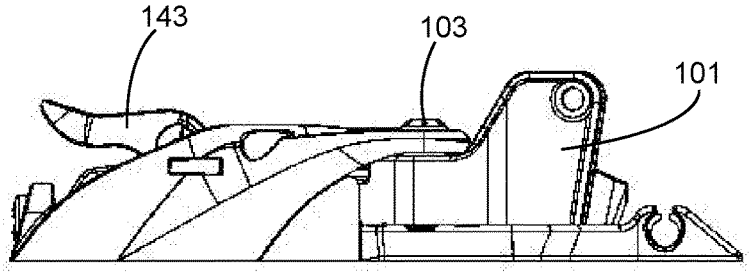
FIG. 5 represents a side view of the toe piece according to the first embodiment of the invention in the fitting configuration.
Figure 6:
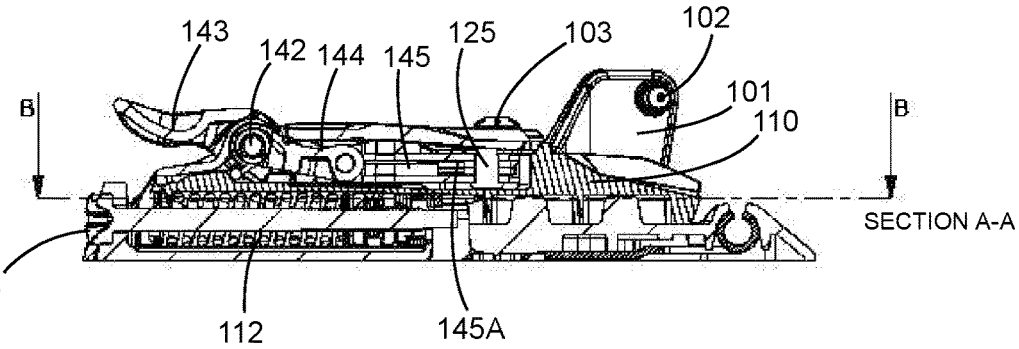
FIG. 6 represents a side view in cross section along a vertical longitudinal median plane of the toe piece according to the first embodiment of the invention in the fitting configuration.
Figure 4:
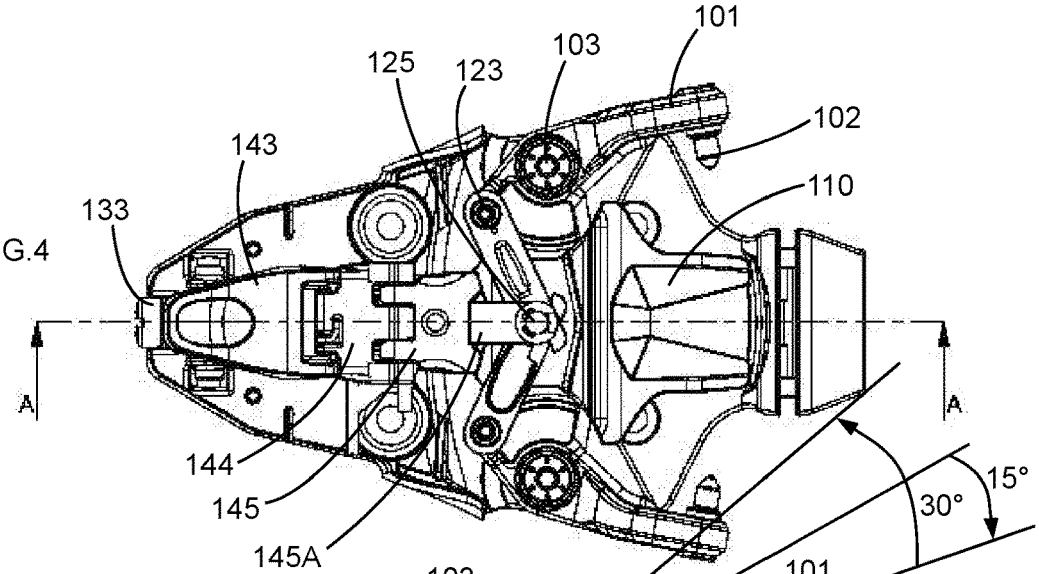
FIG. 4 represents a plan view without cap of the toe piece according to the first embodiment of the invention in a fitting configuration.
Figure 7:
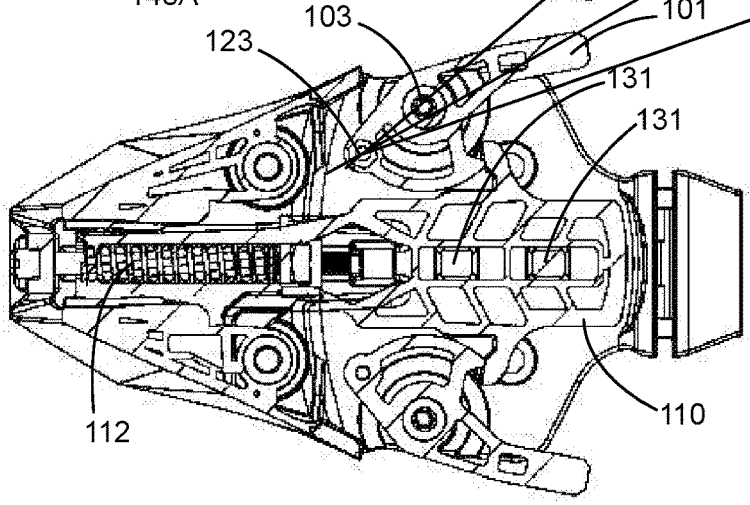
FIG. 7 represents a plan view in cross section along a horizontal plane of the toe piece according to the first embodiment of the invention in the fitting configuration.
Figure 12:
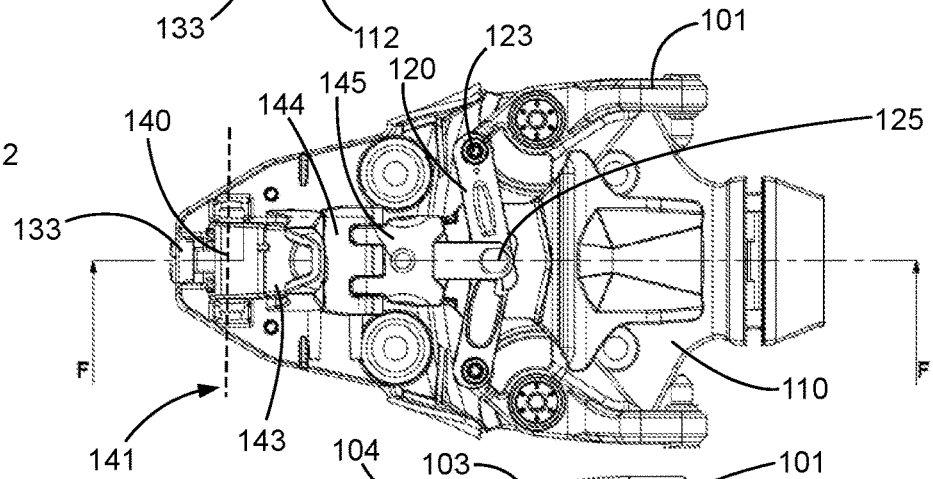
FIG. 12 represents a plan view without cap of the toe piece according to the first embodiment of the invention in a climb configuration.
Figure 16:
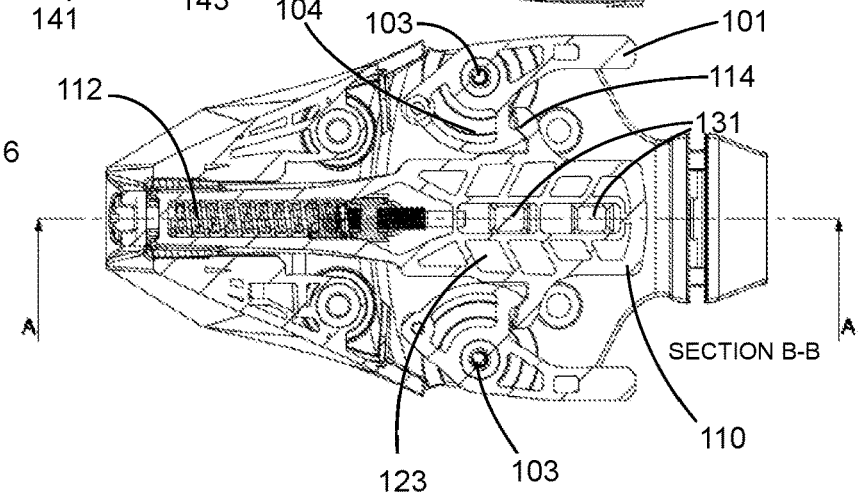
FIG. 16 represents a plan view in cross section along a horizontal plane of the toe piece according to the first embodiment of the invention in the climb configuration.
Figure 17:
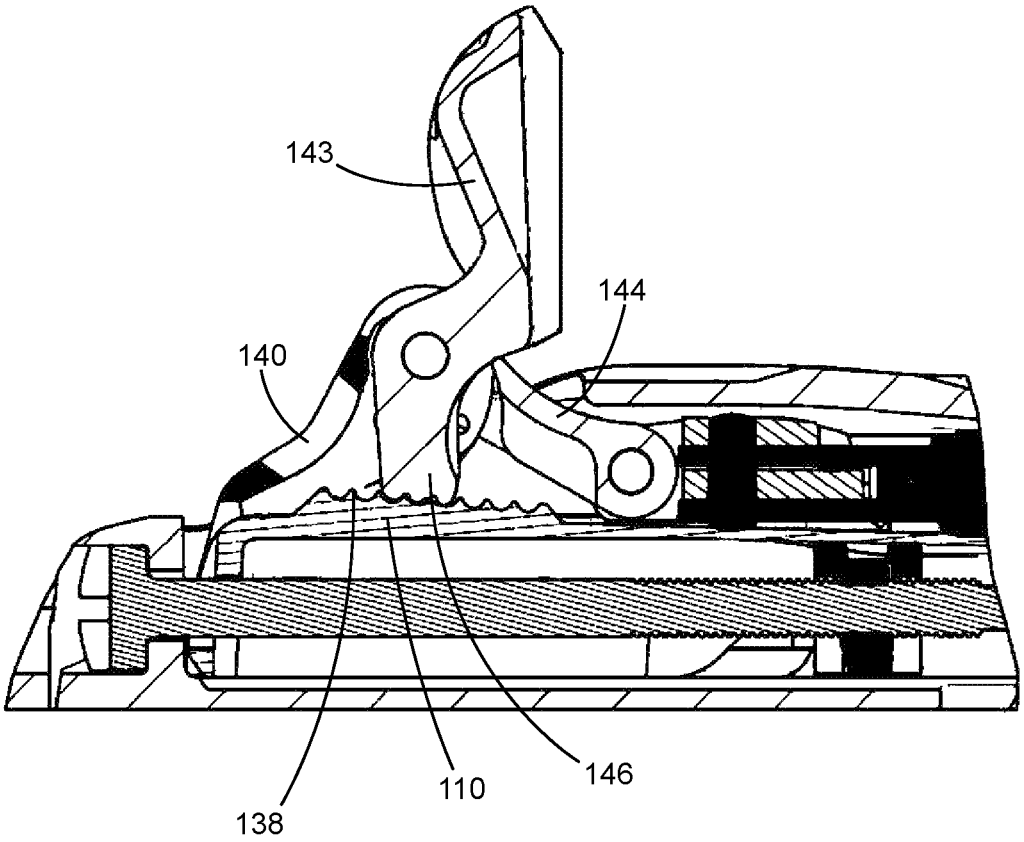
FIG. 17 represents a side view in cross section of the toe piece according to a variant of the first embodiment of the invention in the climb configuration.
Figure 18:
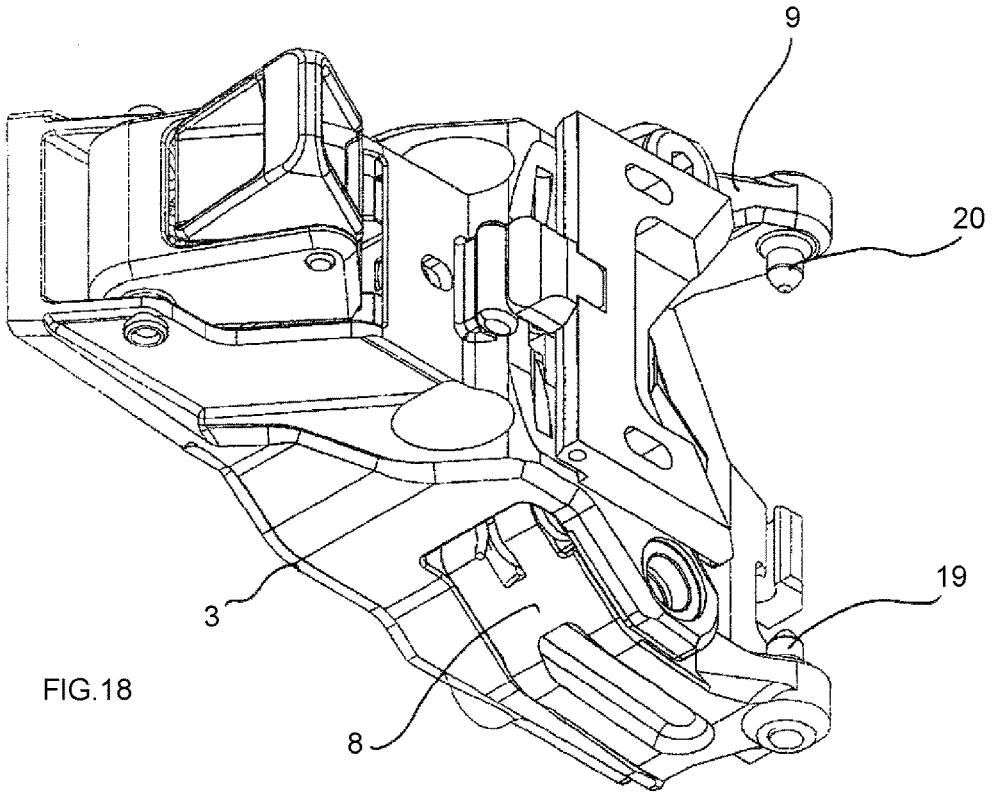
FIG. 18 represents a three-dimensional view of the front of the toe piece according to a second embodiment of the invention in a downhill configuration.
Figure 19:
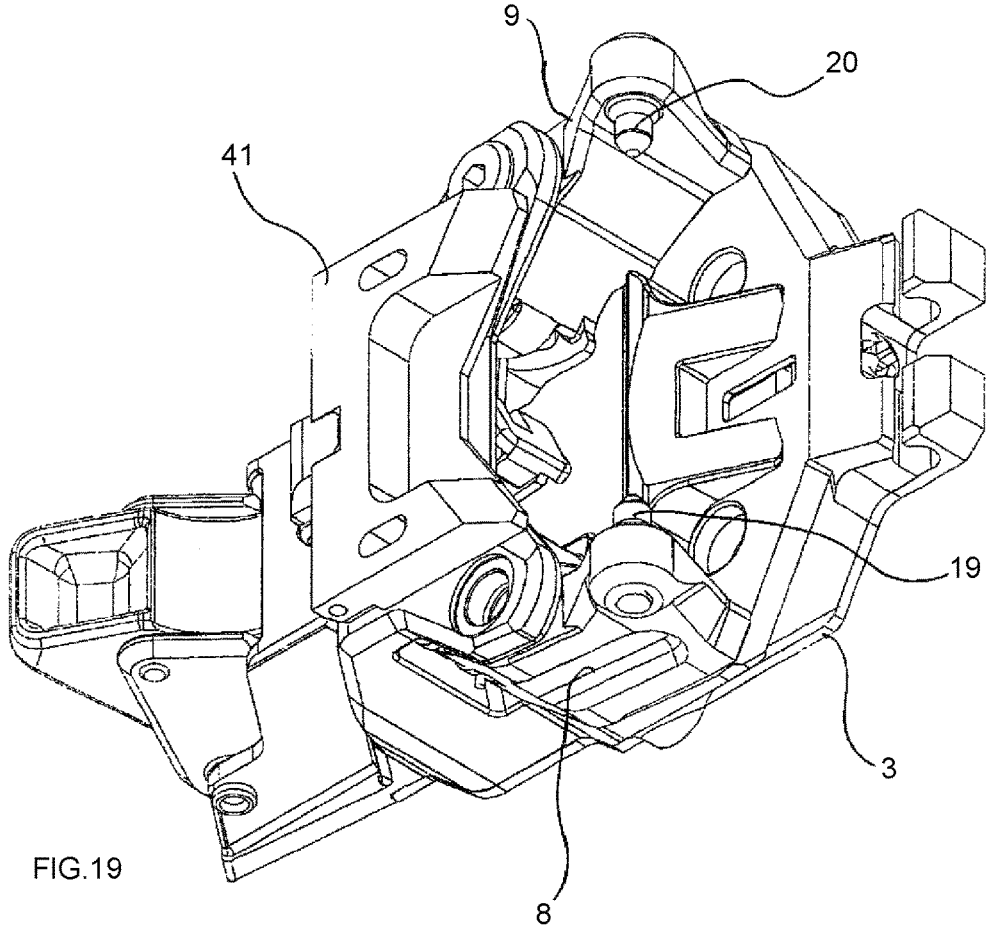
FIG. 19 illustrates a three-dimensional view of the rear of the toe piece according to the second embodiment of the invention in a downhill configuration.
Figure 20:
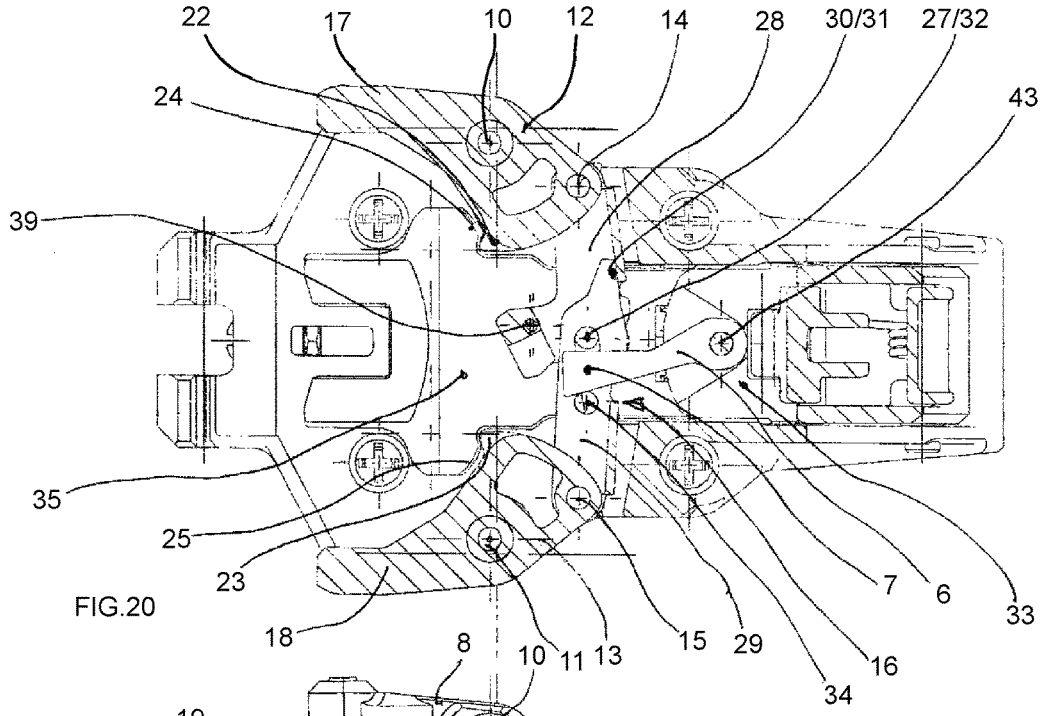
FIG. 20 illustrates a plan view in cross section of the toe piece according to the second embodiment of the invention.
Figure 21:
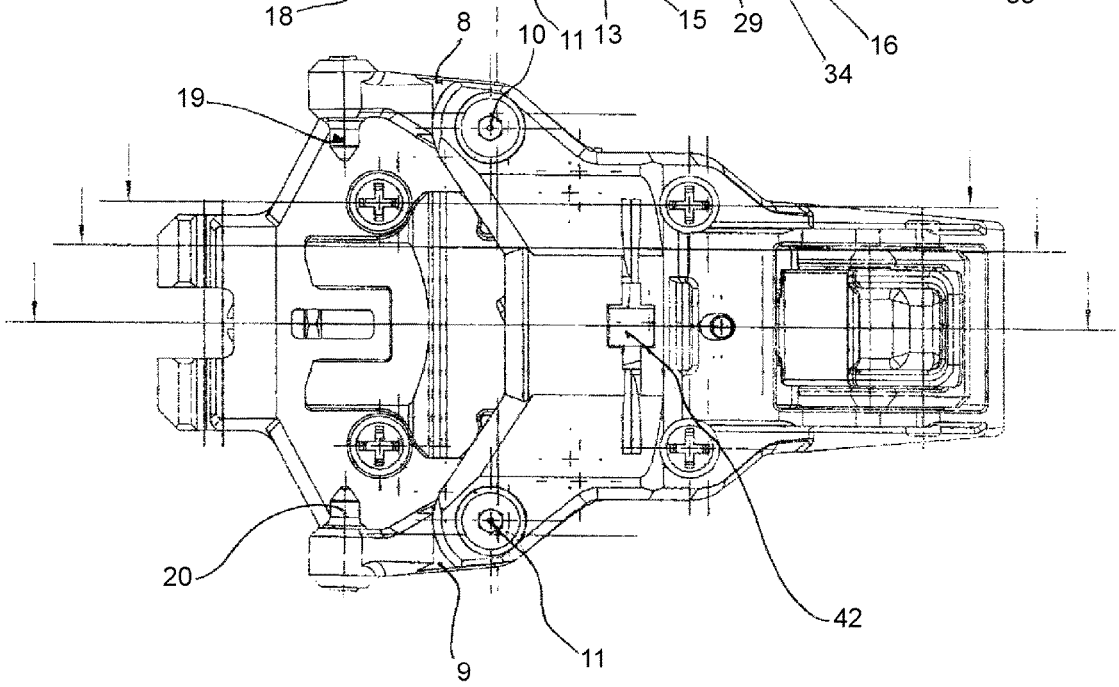
FIG. 21 illustrates a plan view of the toe piece according to the second embodiment of the invention.
Figure 22:
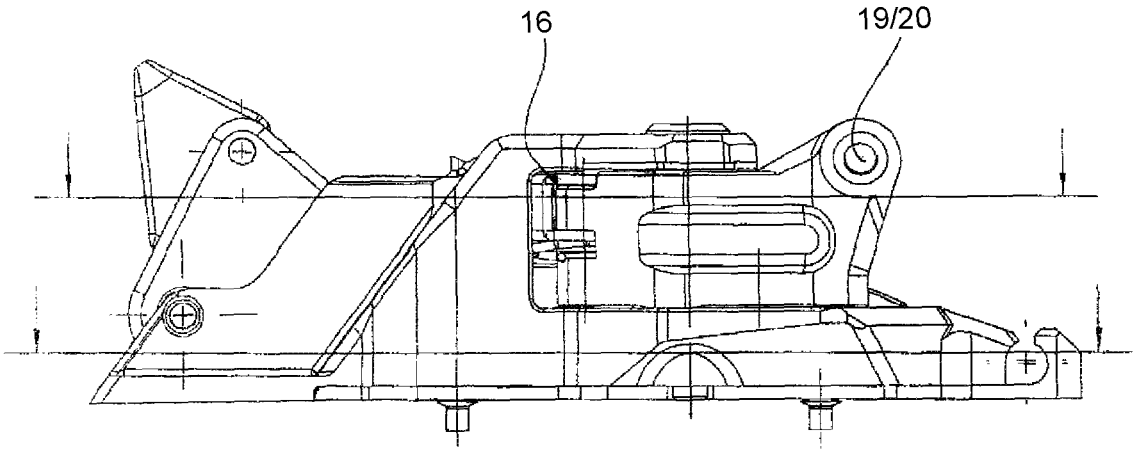
FIG. 22 illustrates a side view of the toe piece according to the second embodiment of the invention.
Figure 23:
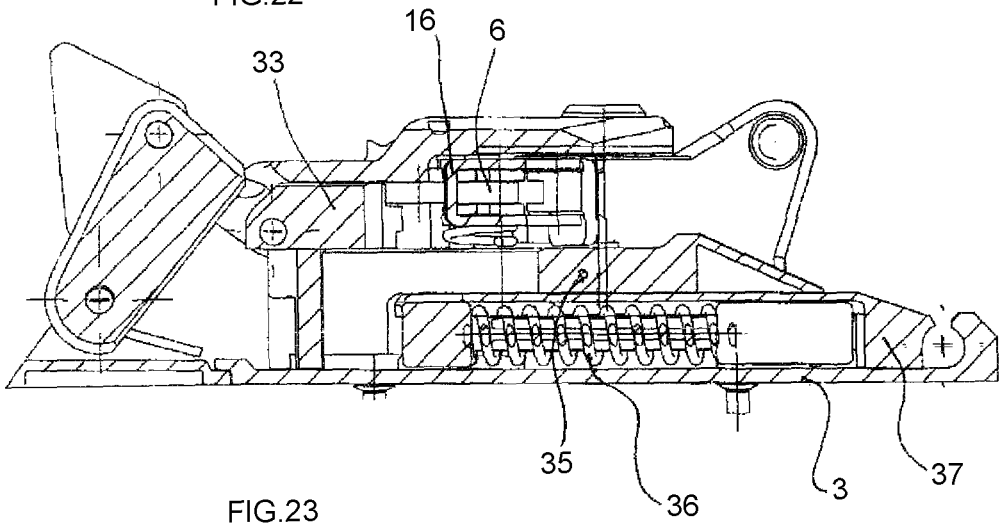
FIG. 23 illustrates a side view according to a first cross section of the toe piece according to the second embodiment of the invention.
Figure 24:
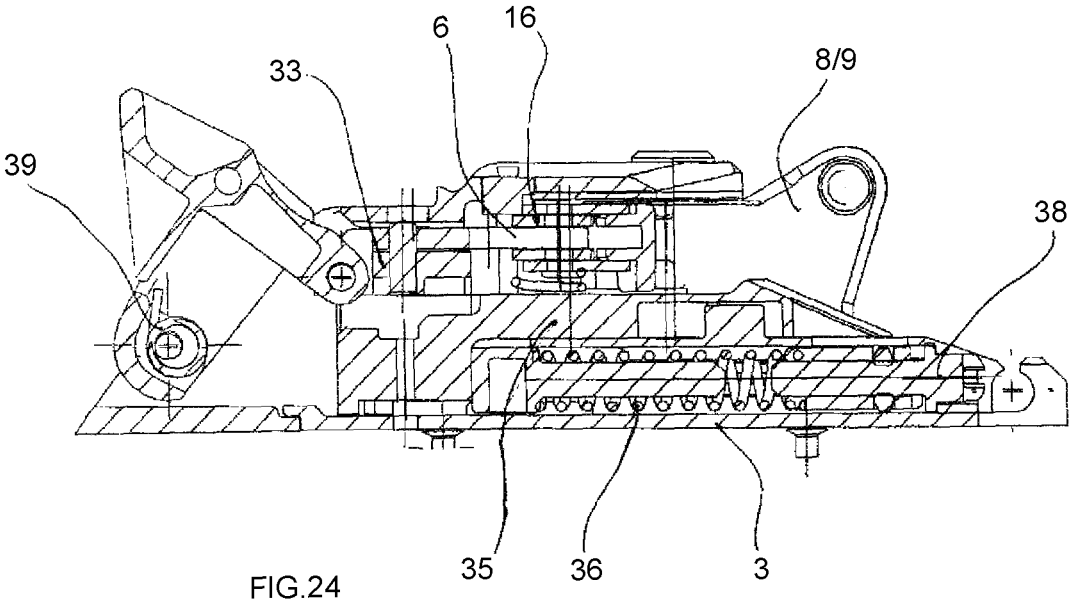
FIG. 24 illustrates a side view according to a second cross section of the toe piece according to the second embodiment of the invention.

This actuation device comprises a front-end support 140 mounted to be rotationally mobile in its lower front part relative to the base 130 of the toe piece, about a transverse axis 141, represented in particular in FIGS. 2 and 12. It bears a second axis in its second, upper rear end, which forms a rotation axis 142 for a lever 143. In effect, a lever 143 comprising a gripping zone for it to be easily manipulated by a user is mounted to be rotationally mobile about this substantially transverse rotation axis 142; it is also stressed by an optional return spring arranged around this rotation axis 142. The actuation device also comprises an intermediate piece 144 of which a front end is fastened to the front-end support 140 and/or to the lever 143 at the level of the rotation axis 142 of the lever. This intermediate piece 144 finally comprises a connection on one side with the links 120 via a connection element, consisting of one or more pieces 145, 145A, translationally mobile longitudinally, and on the other hand with the pusher 110. This connection element 145, 145A is more specifically linked to the central axis 125 of the links 120. In other words, the lever 143 is mounted to rotate on two pieces that are rotationally mobile in relation to the base 130, the front-end support 140 at the front, linked to the base, and the intermediate piece 144 at the rear, linked to the jaws. These three pieces 143, 140, 144 are linked together by a common rotation axis, the rotation axis 142 of the lever 143.

In this embodiment, the cap 150 covers the links and, partially, the pusher, and has an opening in its front part for the passage of the actuation device, in particular the lever. It also comprises lateral walls protecting the lateral parts of the actuation device and of the trig mechanism.

The operation of this actuation device will now be explained.

In the fitting configuration of the toe piece, the lever 143 is turned to the maximum downward, toward the front of the toe piece, about its rotation axis 142. It reaches a substantially horizontal positioning. This actuation also has the effect of driving the rotation toward the rear of the front-end support 140 and the positioning in low and retracted position of the rotation axis 142 of the lever 143. The result thereof is that the connection element 145, 145A is pushed to the rear, via the intermediate piece 144, and therefore pushes back toward the rear the central axis 125 of the links 120 and of the pusher 110 to reach the fitting configuration described previously. In this configuration, the trig spring 112, which is compressed, exerts a return force against the actuation device. This first position of the lever 143 in fitting configuration is maintained by a permanent pressure on the lever 143, for example via a rod.

In the downhill configuration of the toe piece, the lever is in a raised intermediate position. This position is reached easily by the elastic return exerted on the actuation device by virtue of the construction of butterfly catch type when the skier releases the pressure on the lever 143. In this configuration, the pressure on the central axis 125 of the links 120 is relaxed and the pusher 110 and links 120 assembly reverts to a position in which the trig spring 112 is not compressed or less compressed. In this configuration, the jaws 101 are held in their boot-holding position, under the effect of a pusher, and the trig function described previously is active. The second position of the lever is a stable position. Note that this position depends on the width of the boot, since the actuation device is also configured to adapt to different boot widths.

Finally, the climb configuration is reached by a backward swiveling of the lever 143, by a manual actuation or via a rod, to reach a substantially vertical position. As can be seen in particular in FIG. 15, the lever 143 comprises at least one finger 146 toward its bottom end, opposite its gripping zone, more specifically two lateral fingers in this embodiment, which cooperate with a notched surface 138 of the base or, in a variant not represented, of the cap, or, in a variant, of the pusher, as represented by the variant embodiment of FIG. 17. This cooperation ensures the holding of the lever in this third position, and the stability of the climb configuration, the displacement of the rotation axis 142, and of the actuation device as a whole, being blocked. The choice of the notch corresponds also on a setting of a certain separation of the jaws. In this position, the lever 143 exerts a force on the central axis 125 of the links, via the connection element 145, 145A and the intermediate piece 144. This force is sufficient to prevent any translation of the pusher 110 and movement of the links 120 under the effect of forces from the boot on the jaws. The trig function is thus locked and inactive. Furthermore, this force also positions the jaws according to a certain chosen separation, as a function of the notch of the notched surface 138, which allows the toe piece to be adapted for a use with boots of different size, in particular of different width. Note that the actuation device is in a stable position in this climb configuration.

Thus, the actuation device described above offers the advantage of being able to occupy three configurations corresponding to three positions of the lever, which allows it alone to determine one of the three configurations of the toe piece. There is no need for an additional distinct lock or actuator. Note that its construction with three elements, the mobile support 140, the lever 143 and the intermediate piece 144, linked together at the level of a rotation axis 142 of the lever 143, forms an assembly of butterfly catch type, which makes it possible to achieve the different positions mentioned previously. Note that, in this construction, the rotation axis 142 is mobile relative to the base 130 of the toe piece. This assembly forming the actuation device is subjected to the energy of the trig spring of the toe piece, particularly in its operation according to the butterfly catch mechanism.

Naturally, the invention is not limited to the above description. For example, another actuation device could be arranged on the toe piece for the choice of configuration thereof. This actuation device could comprise several distinct actuators, for example a lever for two positions and an additional lock to deactivate the trig function in climb phase. Also, this actuation device could act differently on the mechanism of the toe piece, on the links and/or the pusher, even directly on the jaws.

Furthermore, the jaws could cooperate with a pusher of different form and/or which moves differently, for example having a degree of freedom in a transverse direction, and not only a longitudinal direction, even be driven by a rotation. Likewise, the links could have other geometries and displacements, and be actuated differently. They could also be linked to the pusher indirectly, and not directly as in the embodiment described.

FIGS. 18 to 27 illustrate a second embodiment of the invention.

To attach the ski boot (not represented), two jaws 8, 9 are provided, these jaws being arranged so as to be rotationally mobile about rotation axes of the jaws 10, 11 in relation to a baseplate or base 3.

These jaws 8, 9 that can pivot have an attachment arm 12, 13 each extending from the rotation axes of the jaws 10, 11 to a link-jaw attachment points 14, 15. A link 16 is articulated at these link-jaw attachment points 14, 15, said links being linked to one another by bolts (not represented) engaged in the link-jaw attachment points 14, 15.

The articulated connection of the jaws 8, 9 via the rotation axes 10, 11 of the jaws with the baseplate 3 resting below and via the link-jaw attachment points 14, 15 with the link 16 allows the link to slide over a line linking the link-jaw attachment points 14, 15.

A holding arm 17, 18 at the end of which a holding pin 19, 20 is respectively provided, extends on the side of the jaws 8, 9 opposite the link-jaw attachment points and the link, said pin extending parallel to the link 16.

The result thereof is a parallelogram in which the two sides are formed by the jaws, the top line being formed by the link and the bottom line being formed by the toe of the boot gripped between the holding pins 19, 20. To guide the ski boot during a movement of the jaws 8, 9, the jaws 8, 9 include jaw ramps 22, 23 that make it possible, upon the movement of the jaws 8, 9, to exert a pressure from the jaws 8, 9 on the toe of the ski boot. This ramp of the jaws 22, 23 acts preferably together with the trig surfaces (or ramps) 24, 25 of a pusher against said pusher 35.

The link 16 comprises two link arms 28, 29, that will alternatively be more simply called "links", linked together via a link connection 27. These link arms 28, 29 are arranged between the link-jaw attachment points 14, 15 such that they can transmit a thrust force with a component extending transversely to the line linking the attachment points 14, 15. Although the link 16 is composed of two link arms 28, 29 linked to a link connection 27, the link 16 thus acts as a bar in a single piece transmitting the thrust force. This is mostly realized by the fact that the link arms 28, 29 comprise, in addition to the link connection 27, a bearing surface 30, 31 at which the link arms 28, 29 rest against one another.

An axis cam 32, an oblong hole 40 and an attachment cam 34 are provided in the link connection 27, these elements cooperating with a separation keyway 6. This separation keyway 6 has a V-shaped bearing surface 7 through which the cams 32 and 34 are separated from one another over the length of the oblong hole 40.

One link arm 28 or 29 can include a positioning stop 39 which, when the link connection is folded, serves as positioning stop for a ski boot upon its entry into the fastening.

The pusher 35 is slid against the force of a return spring 36. This return spring (or trig spring) 36 bears on the one hand against the pusher 35 and on the other hand against a bearing 37 fixed to the baseplate 3. An adjustment screw 38 in this case makes it possible to vary the tension of the return spring 36.

The cross-sectional view through the front jaw indicates the base position seen from above, corresponding to the climb and downhill position. The jaws 8, 9 rest essentially aligned parallel to one another and in the longitudinal direction of the baseplate 3 and/or of a ski placed underneath. The link 16 linking the jaws 8, 9 acts in such a way that, in case of lateral separation of a holding pin 20, the opposite holding pin 19 is then guided jointly such that the ski boot (not represented) remains held firmly by the jaws 8, 9. The return spring 36 acts on the holding pins 19 and 20 via the pusher 35 and the ramps of jaws 22 and 23.

A spring element 39 pulls the piston 33 at the level of which the separation keyway 6 is arranged with its bearing surfaces 7 above the point of rotation 43, between the cams 32 and 34, in the direction F, and thus holds the link arms 28, 29 taut at the stop 30/31.

A device 41 on the upper side of the ski fastening, when it is strongly stressed by the toe of the ski boot, can press a lever or a pusher 42 against the link 16. That folds the link in the form of a V and thus reduces the separation between the attachment points 14, 15 to thus be able to separate the ends of the jaws 17, 18 where the holding pins 19, 20 can be arranged and release the ski boot.

Finally, one advantage of the solution stems from the attachment points of the jaws linked together via a link. That means that the jaws are not displaced independently of one another, but that a displacement of one jaw necessarily causes a movement of the other jaw. That makes it possible to fix the ski fastening in such a way that a boot attached in the ski fastening can have a certain movement play without becoming detached from the fastening. Only when a predefined play is exceeded will the jaws release the ski boot.

It is advantageous, for that to be possible, for the link to be able to slide on a line linking the link-jaw attachment points. The link can thus slide for example in relation to a baseplate or in relation to the ski on which the ski fastening is arranged. With the rotation axes of the jaws being fixed, such a sliding on a line between the link-jaw attachment points provokes a sliding of the jaw position and thus a movement of the ski boot attached in the ski fastening.

To hold a ski boot firmly, but in such a way as to be rotationally mobile at the level of the ski fastening and in particular at the level of the jaws, it is proposed in this second embodiment that the jaws include an attachment arm extending from the rotation axis of the jaws to the link-jaw attachment point and a holding arm extending from the rotation axis of the jaws to a holding pin. That makes it possible to attach a ski boot between two holding pins of two jaws by introducing the holding pins into the corresponding voids at the toe of the ski boot.

To simplify opening the ski fastening, it is proposed in this second embodiment that the link include two link arms linked together via a link connection. That makes it possible to fold the link and thus reduce the separation between the attachment points to separate the ends of the jaws where the holding pins can be arranged.

A link connection makes the transmission of a thrust force toward the link more difficult. It is thus proposed that the link arms be arranged between the link-jaw attachment points such that they can transmit a thrust force with a component extending transversely to the line of the attachment points.

A simple way to realize it is for the link arms to include, in addition to the link connection makes, a bearing surface. The link connection could however also include, for example, predefined positions for snap fitting attaching the link arms in a specific orientation relative to one another.

To displace the link arms in a controlled manner, it is proposed that the link connection include a cam guided in an oblong hole and that the cam be disposed fixedly. A second cam acts as counter-bearing on the other link arm. In this case, the cams can form part of the link.

To guarantee in particular an automatic widthwise adaptation of the jaws relative to one another and to a ski boot, it is proposed that the link arms be pushed back away from one another against the cam within the limiting lengthwise measurement of the oblong hole using a separation keyway.

An advantageous variant embodiment provides for the separation keyway to be arranged around an axis that can pivot vertically, at the level of a piston that can slide only in a plane transversely to a line linking the rotation axes of the jaws. This piston, preferably mobile in the longitudinal direction of the ski and under spring tension, pulls the separation keyway between the cams over the maximum separation width permitted in each case by the length of the oblong hole.

In this case, it is advantageous for the piston to be able to slide against the force of a spring attached on the one hand to the piston that can slide and on the other hand to a fixed bearing. The fixed bearing can cause the separation keyway to always have the greater separation effect compared to the cams, and therefore compared to the link arms.

Given that, depending on the embodiment of the holding pins and of the voids of the ski boot, the separation between the holding pins in their attachment position varies, the device described above is proposed to compensate this play. The link to this end comprises two link arms linked together so as to be able to pivot via an attachment cam guided in an oblong hole. An attachment cam is arranged on a link arm and an axis cam and an oblong hole, in which the opposite attachment cam is guided, are arranged at the other link arm. A movement of the attachment cam and of the axis cam toward the tip of the ski displaces the holding pins toward one another whereas the separation keyway slides along the attachment and control cam. The separation keyway in this case pushes back the link arms away from one another only to the point where the holding pins adopt the separation needed for a safe attachment of the ski boot and for the link arms to be approximately aligned on a line.

To safely attach the ski boot, it is proposed in this second embodiment that the jaw include a bearing surface cooperating with the counter-surfaces at a spring-loaded pusher respectively including, in turn, a trig edge. As long as the jaws are loaded uniformly via these bearing surfaces, the holding pins try to adopt the least possible separation relative to one another in the jaws.

It is in this case advantageous for the jaws controlled by the spring-loaded pusher to first of all adopt, via the holding pins, their end position in the ski boot voids. The separation keyway, with a slight delay, must then push back the link arms away from one another and act as a spacer on the link arms.

When a skier falls forward, therefore in the direction of travel, the ski fastening must immediately be released in the forward direction. To allow an opening of the ski fastening in this direction, it is proposed in this second embodiment that the link include two link arms linked together via a link connection and a device on an upper side of the ski fastening which, when it is strongly stressed by the toe of the boot, presses directly or via an additional lever against the link in such a way that the link folds into a position before the dead point and thus reduces the separation between the attachment points, making it possible to separate from one another the ends of the jaws where the holding pins can be arranged, to release the ski boot.

The invention claimed is:

1. A toe piece for a device for fastening a boot on a sliding board, the toe piece comprising:

a base intended to be fixed to the sliding board, two lateral jaws, each mounted to be rotationally mobile on the base about a substantially vertical rotation axis, so as to be able to occupy a closed position in which they are able to hold the boot on the sliding board and a separated position in which they are able to receive the boot, a pusher comprising two lateral trig surfaces each cooperating with a respective ramp of each of the jaws, the pusher being linked to the base by a trig spring which makes it possible to control a displacement of the pusher, and two links each linked to one of the jaws by a first lateral axis and linked together by at least one central axis.

2. The toe piece according to claim 1, wherein the links are directly linked to the pusher.

3. The toe piece according to claim 2, wherein the links are directly linked to the pusher via the central axis.

4. The toe piece according to claim 2, wherein the lateral axis of the links is arranged at a front of the rotation axis of the jaws and wherein the ramp of the jaws is arranged at a rear of the rotation axis of the jaws.

5. The toe piece according to claim 2, wherein the ramp of each of the jaws remains bearing against a trig surface formed by a lateral finger inclined toward a front of the pusher, the trig surface being positioned at a rear of the ramp.

6. The toe piece according to claim 2, wherein each of the jaws comprises a retaining element in a top rear part.

7. The toe piece according to claim 2, wherein the pusher is translationally mobile longitudinally relative to the base.

8. The toe piece according to claim 1, wherein the lateral axis of the links is arranged at a front of the rotation axis of the jaws and wherein the ramp of the jaws is arranged at a rear of the rotation axis of the jaws.

9. The toe piece according to claim 8, wherein the ramp of each of the jaws remains bearing against a trig surface formed by a lateral finger inclined toward a front of the pusher, the trig surface being positioned at a rear of the ramp.

10. The toe piece according to claim 1, wherein the ramp of each of the jaws remains bearing against a trig surface formed by a lateral finger inclined toward a front of the pusher, the trig surface being positioned at a rear of the ramp.

11. The toe piece according to claim 1, wherein each of the jaws comprises a retaining element in a top rear part.

12. The toe piece according to claim 11, wherein the retaining element is in the form of a holding pin.

13. The toe piece according to claim 1, wherein the pusher is translationally mobile longitudinally relative to the base.

14. The toe piece according to claim 1, wherein the trig spring extends longitudinally at the center of the toe piece, is fastened to the base by a stop toward a rear end of the trig spring and is linked to the pusher toward a front end of the trig spring.

15. The toe piece according to claim 1, comprising an actuation device which makes it possible to act on the links and/or the pusher so as to position the toe piece in one of the following three configurations:

a fitting configuration, in which the actuation device pushes back the central axis of the links and the pusher toward the rear, and in which the jaws are in a separated position in which they can receive the boot;

a downhill configuration, in which the jaws are in a closed position holding the boot, and in which the links and the pusher are mobile to allow the trigging of the toe piece in case of torsional load above a chosen threshold exerted by the boot;

a climb configuration, in which the jaws are in a closed position holding the boot, and in which the links and the pusher are in a locked position preventing the trigging of the toe piece.

16. The toe piece according to claim 15, wherein the actuation device comprises a front-end support mounted to be rotationally mobile in its front part relative to the base, a lever mounted to be rotationally mobile about a rotational axis mounted in a rear part of the front-end support, an intermediate piece whose front end is fixed to the front-end support and/or to the lever at the level of the rotational axis of the lever, the intermediate piece comprising a connection with the links via a connection element translationally mobile longitudinally, linked to the central axis of the links.

17. The toe piece according to claim 16, wherein the actuation device forms an assembly operating according to a butterfly catch mechanism, that can occupy one of the following three positions, a first position in which the lever is in low position oriented forward and in which the rotational axis of the lever is in low position, and in which the toe piece is in fitting configuration;

a second position in which the lever is in an intermediate raised position and in which the rotational axis of the lever is in substantially high position, and in which the toe piece is in downhill configuration;

a third position in which the lever is in a raised position, in which at least one finger of the lever is engaged on a notch of the base or of a cap or of the pusher in which the rotational axis of the lever is in high position, and in which the toe piece is in climb configuration.

18. A device for fastening a boot on a sliding board, comprising (i) the toe piece according to claim 1, intended to ensure the fixing of a front part of the boot, and (ii) a heel piece intended to ensure the optional fastening of a rear part of the boot on the sliding board.

19. A sliding board comprising the fastening device according to claim 18.

20. A sliding board comprising the toe piece according to claim 1.

* * * * *